US007799102B2

(12) United States Patent
Weinberger

(10) Patent No.: US 7,799,102 B2
(45) Date of Patent: Sep. 21, 2010

(54) FIREPLACE FUEL CARTRIDGE FOR RECTANGULAR, SELF REGULATING FLAME PATTERNS

(76) Inventor: Michael Weinberger, 236 W. 26th St., 3rd Floor, New York, NY (US) 10001

( * ) Notice: Subject to any disclaimer, the term of this patent is extended or adjusted under 35 U.S.C. 154(b) by 532 days.

(21) Appl. No.: 10/814,014

(22) Filed: Mar. 30, 2004

(65) Prior Publication Data

US 2005/0227194 A1 Oct. 13, 2005

(51) Int. Cl.
*C10L 11/00* (2006.01)
*C10L 11/06* (2006.01)

(52) U.S. Cl. ..... 44/541; 44/530; 431/356

(58) Field of Classification Search ..... 44/541; 126/283; 431/331, 253
See application file for complete search history.

(56) References Cited

U.S. PATENT DOCUMENTS

| | | | | |
|---|---|---|---|---|
| 852,679 | A | | 5/1907 | Richards |
| 2,212,157 | A | * | 8/1940 | Fernholtz ..... 44/522 |
| 2,306,467 | A | | 12/1942 | Reynolds |
| 2,955,589 | A | | 10/1960 | Arne et al. |
| 3,042,109 | A | | 7/1962 | Peterson |
| 3,262,445 | A | | 7/1966 | Stults |
| 3,292,608 | A | | 12/1966 | Waddell |
| 3,606,609 | A | * | 9/1971 | Lipper et al. ..... 431/152 |
| 3,993,430 | A | | 11/1976 | Forker |
| 4,000,732 | A | | 1/1977 | White |
| 4,076,490 | A | | 2/1978 | Hilker |
| 4,084,086 | A | | 4/1978 | Bandel |
| 4,150,610 | A | | 4/1979 | Ferrara |
| 4,487,572 | A | | 12/1984 | Parker |
| 4,573,905 | A | | 3/1986 | Meyers |
| 4,575,379 | A | | 3/1986 | Browning |
| 4,582,478 | A | | 4/1986 | Hilker |
| 4,604,053 | A | | 8/1986 | De La Rosa |
| 4,637,372 | A | | 1/1987 | Mogol |
| 4,838,781 | A | | 6/1989 | Fischer |
| 4,850,858 | A | | 7/1989 | Blankenship |
| 4,875,464 | A | | 10/1989 | Shimek |
| 4,890,600 | A | | 1/1990 | Meyers |
| 4,896,653 | A | | 1/1990 | Eke |
| 4,940,407 | A | | 7/1990 | Rehberg et al. |
| 5,012,791 | A | | 5/1991 | McCabe |
| 5,026,271 | A | | 6/1991 | Orlov |
| 5,067,476 | A | | 11/1991 | Rhodes |
| 5,118,539 | A | | 6/1992 | Sebby et al. |
| 5,143,046 | A | | 9/1992 | Koziol |
| 5,199,413 | A | * | 4/1993 | Chen ..... 126/43 |
| 5,499,576 | A | | 3/1996 | Grunder |

(Continued)

FOREIGN PATENT DOCUMENTS

| | | |
|---|---|---|
| EP | 0 264 014 | 4/1988 |

*Primary Examiner*—Ellen M McAvoy
*Assistant Examiner*—Vlshal Vasisth
(74) *Attorney, Agent, or Firm*—Robert W. J. Usher

(57) ABSTRACT

In accordance with the present invention a disposable fuel cartridge for use in fireplaces that self regulates the shape, height, width, depth and burn time of the flames produced when the fuel inside the cartridge, such as alcohol gel, is exposed to ambient air and ignited, where the cartridge makes efficient use of fuel so as to produce a desirable, generally rectangular flame pattern without the need for any additional components, such as rectangular "fuel cells" or rectangular damper lids placed over the "fuel cells".

10 Claims, 8 Drawing Sheets

U.S. PATENT DOCUMENTS

| | | | | |
|---|---|---|---|---|
| 5,584,283 | A | 12/1996 | Messina | |
| 5,794,610 | A | 8/1998 | Faccina | |
| 5,829,966 | A | 11/1998 | Stoner | |
| 5,918,592 | A | 7/1999 | Kazubski et al. | |
| 6,035,768 | A * | 3/2000 | Kaufman | 99/449 |
| 6,227,190 | B1 | 5/2001 | Glass | |
| 6,267,113 | B1 | 7/2001 | Maust | |
| 6,296,474 | B1 | 10/2001 | Butler et al. | |
| 6,363,927 | B2 | 4/2002 | Haynes | |
| 6,609,514 | B1 * | 8/2003 | Bertolas | 126/519 |
| 6,755,877 | B2 * | 6/2004 | Perlman | 44/534 |
| 2005/0150487 | A1 | 7/2005 | Weinberger | |
| 2005/0178379 | A1 | 8/2005 | Weinberger | |
| 2005/0247302 | A1 | 11/2005 | Weinberger | |
| 2006/0110695 | A1 | 5/2006 | Weinberger | |
| 2006/0157049 | A1 | 7/2006 | Weinberger | |

* cited by examiner

FIREPLACE FUEL CARTRIDGE FOR RECTANGULAR, SELF REGULATING FLAME PATTERNS

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION—FIELD OF INVENTION

This invention is for a fireplace fuel cartridge, primarily for use in ventless fireplaces although usable in vented fireplaces as well, where the fuel cartridge self regulates the shape, height, width, depth and burn time of the flames produced when the fuel in the cartridge, such as alcohol gel, is ignited, thereby producing a desirable, generally rectangular flame pattern that makes efficient use of fuel, and where the cartridge accomplishes this without a need for additional components such as rectangular holding boxes or damper lids.

BACKGROUND OF THE INVENTION

Ventless fireplaces are very popular. Such fireplaces are easy to install because they do not require chimneys or exhaust systems.

There are two main types of ventless fireplaces. The first type uses gas that is piped into the fireplace. The gas is burned by a type of burner that does not produce appreciable noxious fumes. Typically, such burners provide generally rectangular flame patterns wider than they are deep.

Generally rectangular flame patterns are common to many fireplaces, both vented and ventless. Indeed, the flame pattern in almost all fireplaces is wider than it is deep. Fireplace logs are generally wider than they are deep and many consumers expect fireplace fires to exhibit a generally rectangular flame pattern.

Aside from gas, the second type of ventless fireplace in common use uses a clean burning portable fuel source, typically alcohol gel fuel. Such an alcohol gel is described, for example, in U.S. Pat. No. 4,575,379 to Browning.

Alcohol gel, however, is typically purchased in small round cans that resemble paint cans. These cans usually hold about one pint of fuel, or a little less. Similar to the cans themselves, the lid openings on the cans are also round.

When this "paint can" type canister of alcohol gel fuel is placed inside a fireplace, and the round lid is removed from the round lid opening on top of the can, and the exposed fuel is ignited, a generally round flame is produced.

As discussed previously, however, fireplace flame patterns are generally rectangular, not round. "Paint can" type canisters, therefore, are inherently problematic when used to hold fireplace fuel, because they are not designed to produce a rectangular flame pattern.

In addition, paint cans cannot shape and regulate the width, depth or number of flames that are produced when the fuel inside an individual can is ignited.

Because "paint can" type fuel containers do not have the ability to shape, regulate or control a rectangular flame pattern, inventors have been forced to create other methods for shaping and controlling the flames paint cans produce.

For example, U.S. Pat. No. 4,838,781 to Fischer, discusses a ventless fireplace that uses such cans. The cans are referred to as "cans of gelled fuel" at Col. 5, line 28. Component 31 in FIG. 2 of this patent shows such a round "paint can".

In order to obtain a flame pattern approximating a rectangularly shaped flame pattern Fischer teaches placing a series of round cans in a straight line, and placing the cans in a rectangular receptacle called a "fuel cell". (See claim 1b of the Fischer patent.)

Fischer's rectangular receptacle is also equipped with a rectangular damper lid which the patent states is used to regulate "the burning rate" of the fuel and can "dampen" same.

The rectangular receptacle and rectangular damper lid reshape the configuration of the round fires produced by the "paint cans" so as to produce a quasi-rectangular flame pattern whose width is greater than its depth.

The problems that "paint cans" present when they are used to hold fireplace fuel have been addressed by other inventors, aside from Fischer. For example, Myers also dealt with these problems in U.S. Pat. No. 4,573,905. This patent is also for a ventless alcohol fireplace that uses "standard one-pint size" canisters shown to be round, as component 194 of FIG. 1 of the Myers' patent illustrates.

Similar to Fisher, Myers attempted to solve this problem by using multiple canisters, placed in a straight line. Also similar to Fisher, Myers specifically required the cans to be placed in a rectangular metal box called a "fuel cell". Myer's "fuel cell" holds three cans.

It is inherently inconvenient, inefficient and ineffective, however, to try to achieve a quasi-rectangular flame pattern by placing a series of round "paint cans" next to one another, in a straight line.

For one thing, it requires the use of multiple cans.

For another, it may require the use of rectangular metal receptacles called "fuel cells" to hold the cans, as the Fischer and Myers patents show.

A third problem is that the rectangular "fuel cells" may also require rectangular damper lids to further shape the fire and regulate the burn rate.

A fourth problem is that several round "paint cans", even when placed in a line, do not produce a truly rectangular flame pattern. A truly rectangular flame pattern cannot be achieved no matter how many round cans are used.

A fifth problem is that there will be gaps in the "quasi-rectangular" flame pattern produced by a series of round "paint cans." Gaps will exist where the outside perimeter of one can touches the outside perimeter of the adjacent can, as shown in the FIG. 5 herein.

A sixth problem relates to fuel efficiency. Using "paint cans" to achieve a quasi-rectangular flame pattern is inherently inefficient. It burns more fuel than should be required in order to achieve a somewhat rectangular flame pattern, which it cannot truly do in any event.

For example, if a 10" by 1.25" rectangular flame is desired, this result can be achieved by the current invention by using a rectangular fuel cartridge with a rectangular opening on its top that measures 10"×1.25".

Hence, the current invention achieves a 10"×1.25" rectangular flame pattern by exposing a total of 12.25 square inches of alcohol gel fuel to ambient air, which gel may then be ignited and burned.

"Paint cans", however, expose much more fuel to ambient air in order to attempt to achieve a 10" wide flame pattern.

For example, using "paint cans" with 4" diameters and 3.33" openings, placing three cans in a line will produce a flame pattern that is arguably 10" wide, with gaps, but because each can exposes and burns about 8.7 square inches of fuel, total fuel exposure is approximately 26.1 square inches. This is more than double the 12.25 square inches the current invention requires.

Hence, "paint cans" waste fuel. In this example they expose and burn over 210% more fuel than the current invention, and they still do not produce a truly rectangular flame pattern.

For all these reasons round "paint cans" should not be used to hold alcohol gel fuel intended for use in fireplaces. Rather, it would be much more convenient to fashion a generally rectangular disposable fuel cartridge specifically designed for use in a fireplace, which cartridge has a generally rectangular opening exposing the fuel, and where the opening was specifically designed to self regulate the shape, height, width and depth of the generally rectangular flame pattern produced by the cartridge, as well as the fuel burn rate.

The present invention accomplishes that result.

DISADVANTAGES COMMON TO THE PRIOR ART

The applicant is unaware of any disposable, ventless fireplace gel fuel cartridge sold on the market which self regulates the width and depth of the flame the cartridge produces, so as to create a rectangular flame pattern.

Instead, the prior art utilizes multiple "paint can" type gel fuel canisters. Although one may attempt to obtain a rectangular flame pattern by placing multiple canisters in a straight line, there are inherent disadvantages to this practice.

First it requires the use of multiple canisters versus a single fuel cartridge specifically designed to produce a rectangular flame pattern.

Second, it may require the use of a rectangular metal receptacle called a fuel cell to hold the multiple "paint can" type canisters.

Third, it may also require the use of a rectangular damper lid on top of the rectangular fuel cell, as the prior art discusses.

Fourth, round "paint cans", even when placed next to one another in a line, will produce gaps in the flame pattern, as shown in FIG. 5.

Fifth, "paint cans" are inherently fuel inefficient when used for fireplace fires. They expose more fuel to ambient air than required in order to achieve a desirable rectangular flame pattern.

Sixth, the openings in "paint cans" are not specifically designed to self regulate the size of fireplace flames. Instead, the "paint cans" used in the prior art appear to be just that, paint cans. As the prior art reveals, the paint cans require the use of a rectangular damper lid over a rectangular metal "fuel cell" box to regulate the size of the flames produced.

Seventh, round "paint cans" are inherently inefficient from a storage point of view. They require more cubic inches to store than the rectangular cartridges embodied by the present invention.

BACKGROUND OF INVENTION—OBJECTS AND ADVANTAGES

The objects and advantages of the invention described herein are:

(a) provide a convenient, one piece, disposable fuel cartridge whose configuration is generally rectangular, and which has a generally rectangular opening on its top, so as to produce a rectangular type flame pattern when the fuel inside is ignited.

(b) to provide a convenient, one piece, disposable fuel cartridge whose configuration burns fuel efficiently and requires less fuel than multiple "paint cans" require to produce a generally rectangular flame pattern.

(c) to provide a convenient, one piece, disposable fuel cartridge whose generally rectangular configuration and generally rectangular top opening produces a self regulating rectangular type flame pattern that does not require the use of a damper or a valve.

(d) to provide a convenient, one piece, disposable fuel cartridge whose configuration allows for efficient storage compared to round "paint cans".

SUMMARY

In accordance with the present invention a disposable fuel cartridge for use in fireplaces that self regulates the shape, height, width, depth and burn time of the flames produced when the fuel inside the cartridge, such as alcohol gel, is exposed to ambient air and ignited, so as to produce a desirable, generally rectangular flame pattern without the need for any additional components, such as metal "fuel cell boxes", and where the cartridge makes efficient use of fuel as well as efficient use of storage space.

DRAWINGS—FIGURES

DRAWINGS—REFERENCE NUMERALS

Figure 1:
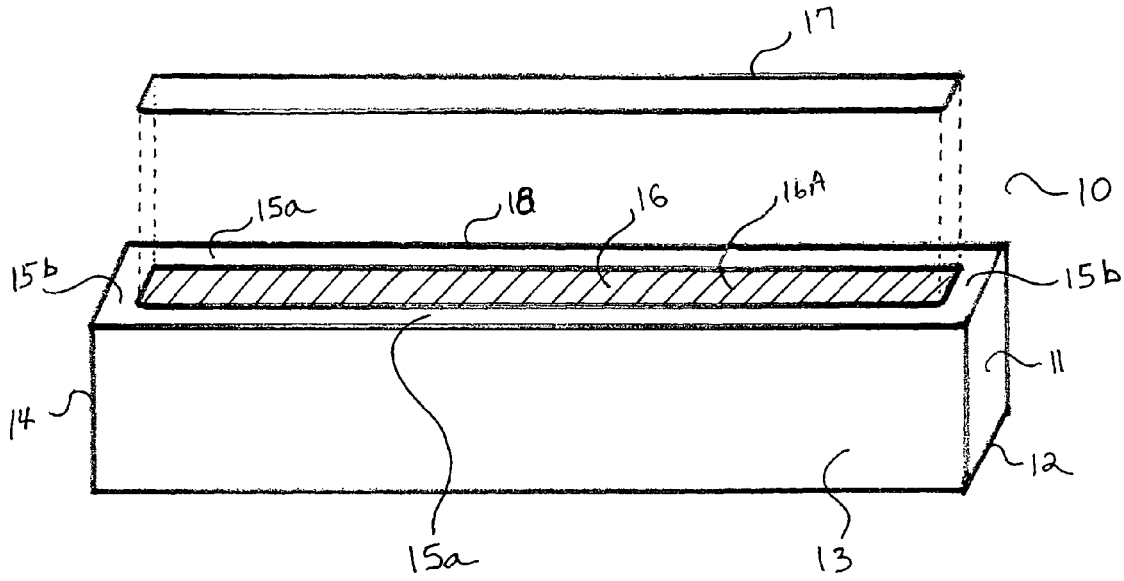
FIG. 1 shows one configuration of a rectangular, metal, disposable gel fuel cartridge, holding gel fuel, where the top of the cartridge has a rectangular vapor exit aperture, a lid that closes the aperture, and vapor restrictors that surround the aperture.

10 Fuel cartridge
10A Generally rectangular fuel cartridge
11 Right sidewall of fuel cartridge
12 Bottom of fuel cartridge
13 Frontwall of fuel cartridge
14 Left sidewall of fuel cartridge
15*a* Front and back vapor restrictors
15*b* Left and right vapor restrictors
15*c* Fuel below vapor restrictors
15*d* Vapor area below vapor restrictors
16 Vapor exit aperture
16A Gel Fuel
16B Generally rectangular vapor exit aperture
17 Removed rigid lid(s)
17A Tape or film like cover for cartridge
17B Generally rectangular rigid lid
18 Backwall of fuel cartridge
20 Rectangular fire
30 Paint can type fuel canister
31 Round fire produced by paint can type fuel canister
32 Flame gap in between fires when three pain can type fuel canisters are placed in a line and their fuel is ignited.
35 Exposed fuel in paint can type canisters

DETAILED DESCRIPTION OF THE PRESENTLY PREFERRED EMBODIMENT

The presently preferred embodiment of the invention is illustrated in the figures. FIG. 1 is a one piece, disposable fuel cartridge 10 preferably made out of thin gauge metal. The fuel cartridge 10 is filled with gelled alcohol 16 or similar fuel. When shipped from its place of manufacture the fuel cartridge 10 will be fully sealed. When the fuel cartridge 10 is open for use, the fuel 16 will sublimate and/or evaporate into vapors which are flammable and which will be ignited and will support combustion.

Figure 3:
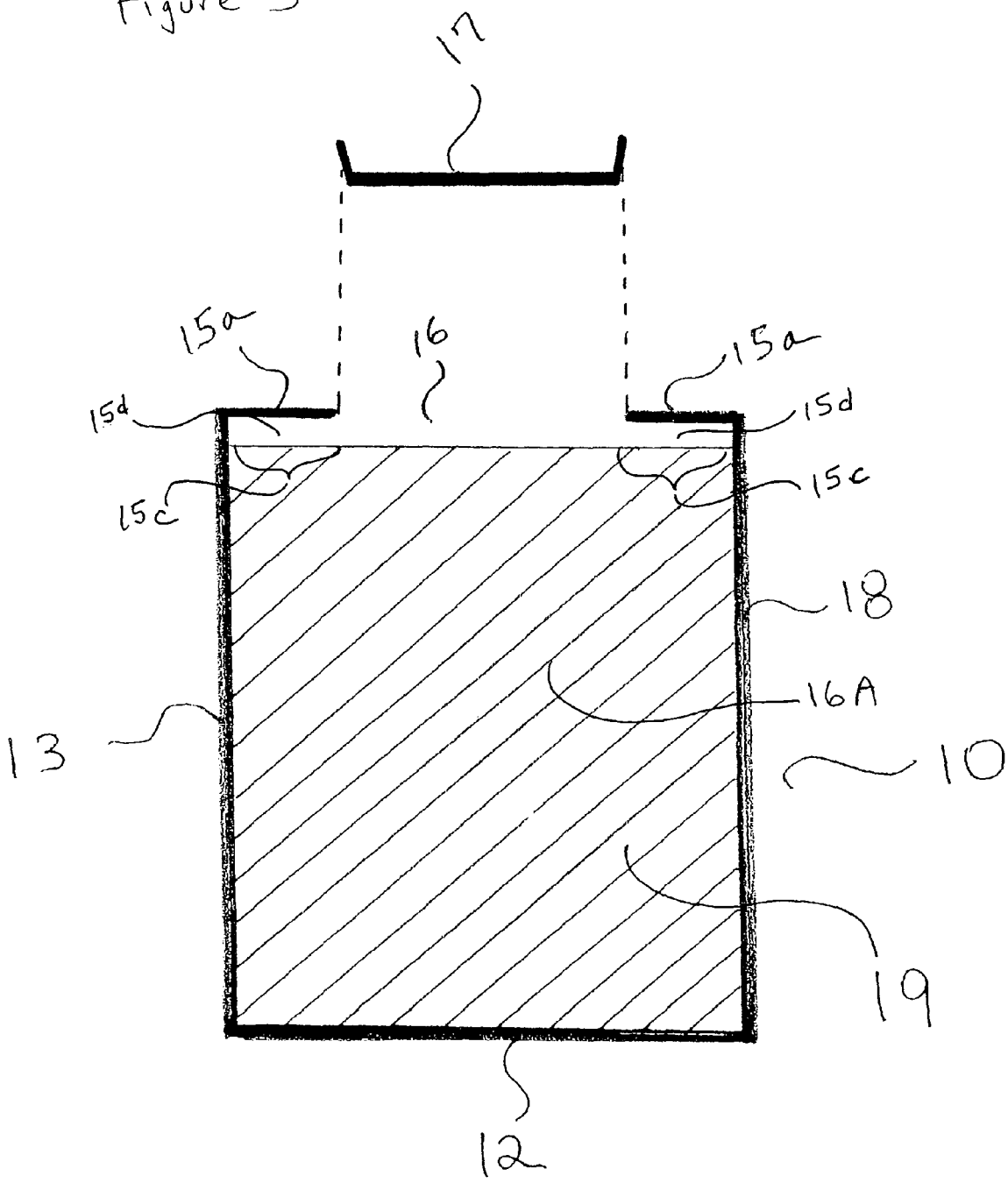
FIG. 3 is a cross section of one configuration of the invention, illustrating the bottom and sidewalls thereof, the vapor exit aperture and the two vapor restrictors in front of and behind the aperture.

As shown, for example, in FIGS. 1 and 3, the fuel cartridge 10 consists of a front wall 13, a back wall 18, sidewalls 11 and 14, front and back vapor restrictors 15*a,* left and right vapor restrictors 15*b* together forming a flat top wall, imperforate except for an elongate, rectangular, vapor exit aperture 16, and a rigid lid 17. When the rigid lid is removed the vapor exit aperture 16 is uncovered which exposes the fuel 16*a* to ambient oxygen. it is apparent that the top wall is rigidly joined to the front, back, left and right walls so that the vapor exit aperture is of predetermined constant size.

Figure 2:
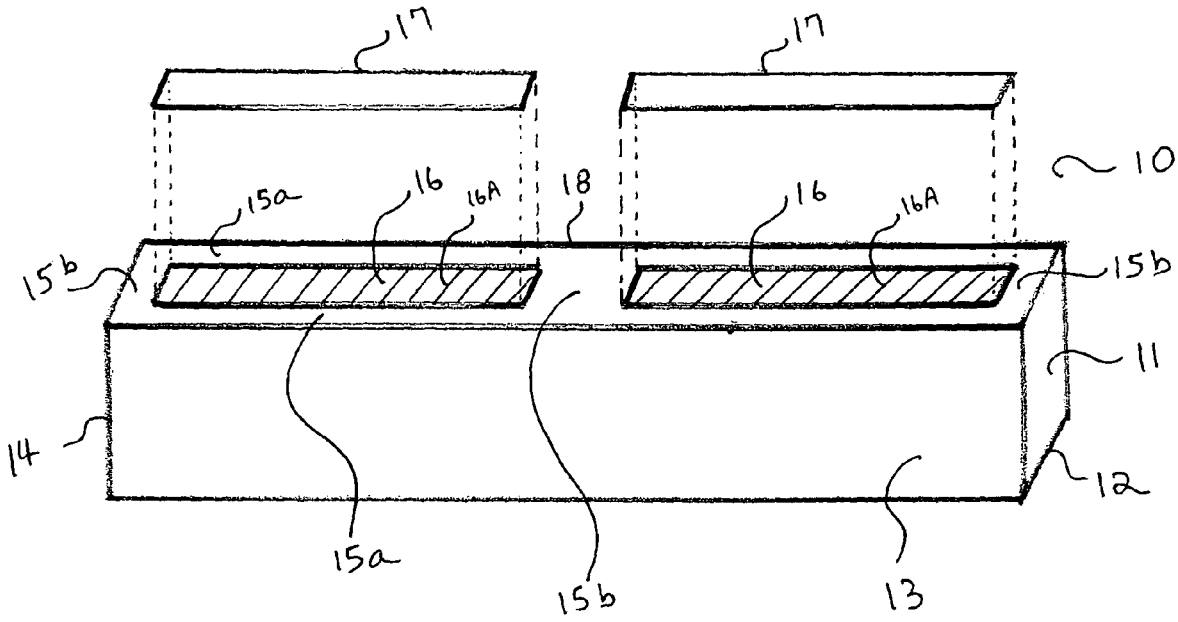
FIG. 2 shows an alternative embodiment of the invention illustrated in FIG. 1 with two rectangular vapor exit apertures.

FIG. 2 shows an alternative embodiment of the present invention with two vapor exit apertures 16 instead of one. Additional vapor exit apertures 16 may also be employed.

FIG. 3 shows a cross sectional view of the fuel cartridge 10 and one configuration of a rigid lid 17. The rigid lid 17 shown is a "plug" type or "friction" type lid that seals the vapor exit aperture 16 after the fuel cartridge 10 has been filled with fuel 16A. The rigid lid 17 seals the fuel cartridge 10 by sitting snugly inside the vapor exit aperture 16, and can be removed by a consumer in order to use the fuel cartridge 10. Other types of lids may also be used, such as "easy off" scored metal lids of the type employed on sardine or soda cans.

FIG. 3 also shows the front and back vapor restrictors 15*a,* which work with the left and right vapor restrictors 15*b* to shape, restrict and control the amount of vapors that leave the fuel cartridge 10.

All four vapor restrictors 15*a-b,* together, create a rectangular vapor exit aperture 16. This creates a generally rectangular flame pattern 20.

In addition, by restricting and controlling vapor flow the vapor restrictors 15*a-b* also allow the fuel cartridge 10 to self regulate the flow of vapor, the size of the fire 20, and the burn time of the fuel cartridge 10, all without the need for the items discussed in the prior art, such as a rectangular "fuel cell" or a rectangular "damper".

The vapor restrictors 15*a-b* restrict vapor flow in two ways. First, they restrict the flow of flammable vapors that can sublimate from the fuel 15*c* that is immediately below the vapor restrictors 15*a-b.* Second, the vapor restrictors 15*a-b* restrict the flow of ambient oxygen into the fuel cartridge 10, including the area 15*d* immediately below the vapor restrictors 15*a-b.*

Assuming one size of fuel cartridge 10 for comparison purposes, larger front and back vapor restrictors 15*a* will create a vapor exit aperture 16 with less depth. For example, on a fuel cartridge 10 with a total depth of 2.5 inches, front and back vapor restrictors 15*a* that are each 0.5 inches in depth will create a vapor exit aperture 16 that is 1.5 inches deep. In turn, this will create a flame pattern 20 that is also approximately 1.5 inches deep.

On that same fuel cartridge 10, if the front and back flame restrictors 15*a-b* are each 0.75 inches deep, the vapor exit aperture 16 will only be 1.0 inches deep, which will result in a flame pattern of approximately the same depth.

Similarly, the size of the left and right flame restrictors 15*b* control the length of the vapor exit aperture 16. For example, on a fuel cartridge 10 with a ten inch length, left and right vapor restrictors 15*b* that are each 0.5 inches will create a vapor exit aperture 16 that is 9.0 inches long. On that same fuel cartridge 10, left and right vapor restrictors 15*b* that are each 1.0 inches will create a vapor exit aperture 16 that is 8.0 inches long.

As a general principle, on a given size of fuel cartridge 10, larger flame restrictors 15*a-b* will result in smaller flames and a longer burn time. Smaller vapor restrictors 15*a-b* will result in larger flames and a shorter burn time.

By varying the length, width and depth of the rectangularly shaped fuel cartridge 10, and by varying the size of the vapor restrictors 15*a-b,* and thereby the flame exit aperture 16, the fuel cartridge 10 can be made to self regulate, so as to produce a larger or smaller fire 20 that can burn for longer or shorter periods of time.

Figure 4:
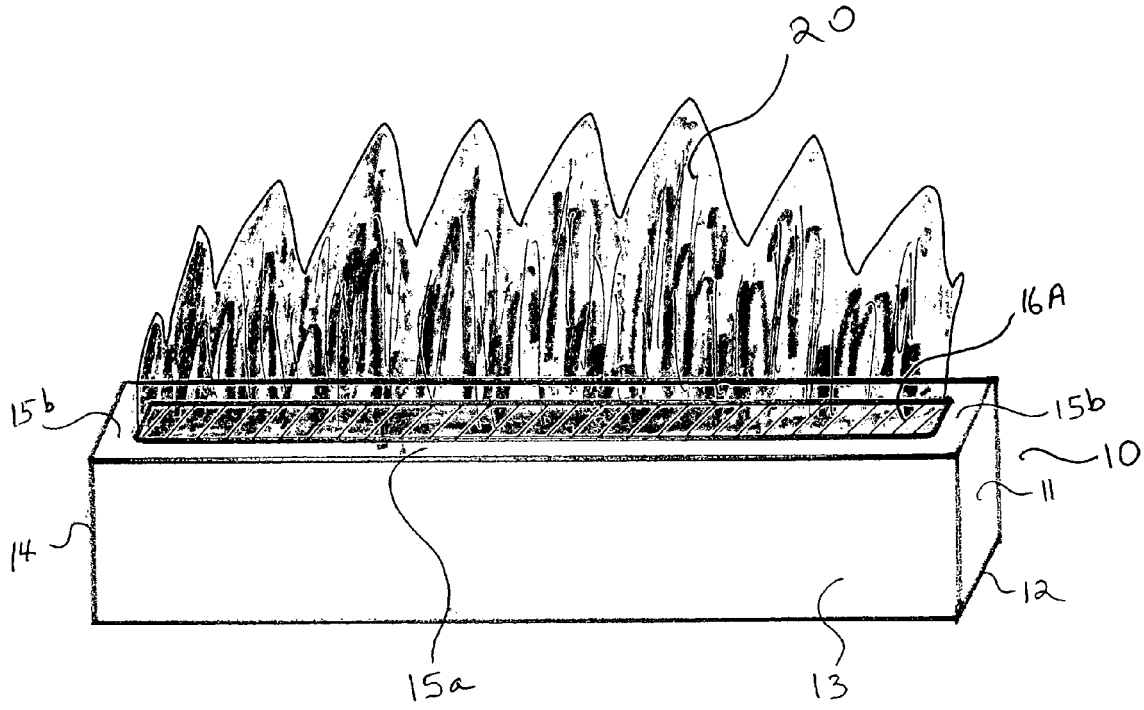
FIG. 4 is a view of the rectangularly shaped fire produced when the lid on top of the fuel cartridge is removed and the fuel inside is ignited.

FIG. 4 shows the generally rectangular flame pattern 20 produced when the fuel 16A inside the fuel cartridge 10 is ignited.

Figure 5:
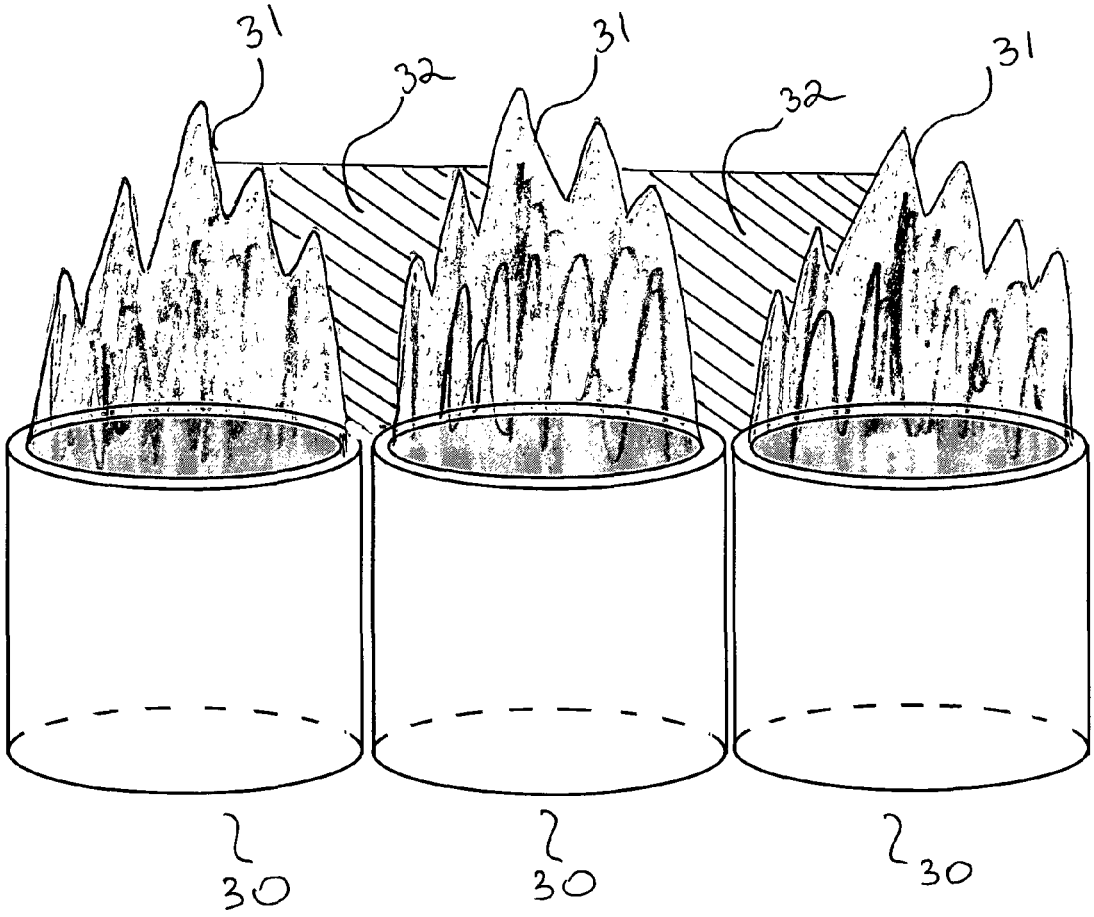
FIG. 5 is a view of three "paint can" type fuel canisters, placed in a line, with their lids removed and the gel fuel in the cans on fire, with two flame gaps on either side of the middle can.

FIG. 5 shows three "paint can" type fuel canisters 30 of the type employed in the prior art, configured in a straight line, as the prior art recommends. The three "paint cans" 30 produce three individual fires 31 and do not provide a truly rectangular flame pattern 20. In addition, this configuration results in flame gaps 32.

Figure 6:
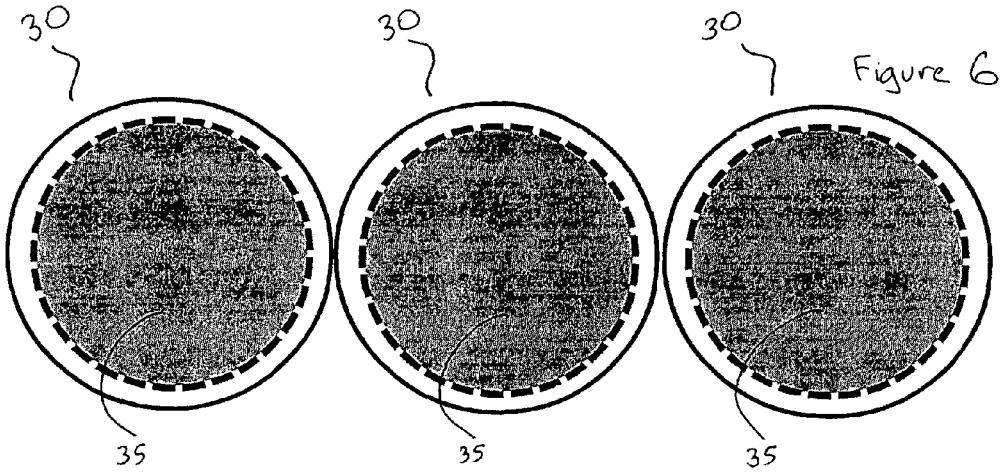
FIG. 6 is a top view of three "paint can" type fuel canisters, placed in a line whose width may be considered "X" inches, whatever that dimension may be, with the lids on each can removed and the gel fuel in the cans exposed and ready to be ignited.

FIG. 6 shows a top view of three canisters 30, and their exposed fuel 35, when the canisters 30 are placed next to one another in a straight line, as the prior art recommends, in order to attempt to achieve a rectangular flame pattern 20.

Figure 7:
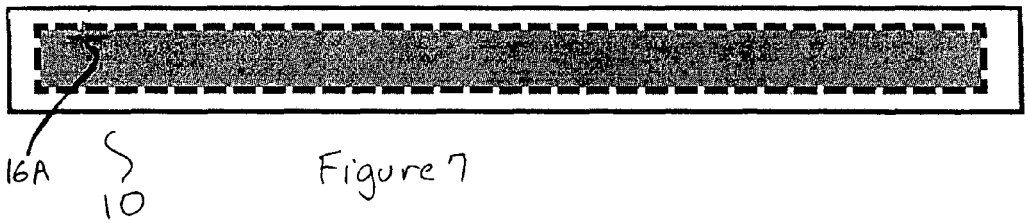
FIG. 7 is a top view of the present invention, with its lid removed and the gel fuel exposed and ready to be ignited, where the width of the exposed gel fuel is also "X" inches, so as to produce a rectangular flame pattern "X" inches wide.

FIG. 7 shows a top view of the present invention fuel cartridge 10 and the exposed fuel 16A used to create a rectangular flame pattern 20.

Figure 8:
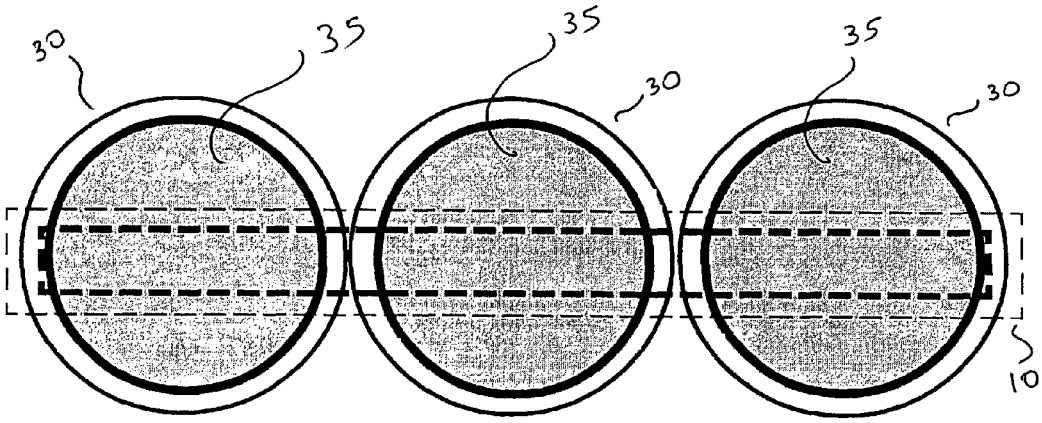
FIG. 8 shows an overlay comparing the amount of exposed fuel that is required to achieve a flame pattern that is "X" inches wide, illustrating that the present invention requires much less fuel to achieve this result.

FIG. 8 is an overlay of FIGS. 6 and 7 illustrating the additional fuel that the prior art "paint cans" use to attempt to achieve a quasi-rectangular flame pattern.

Figure 9:
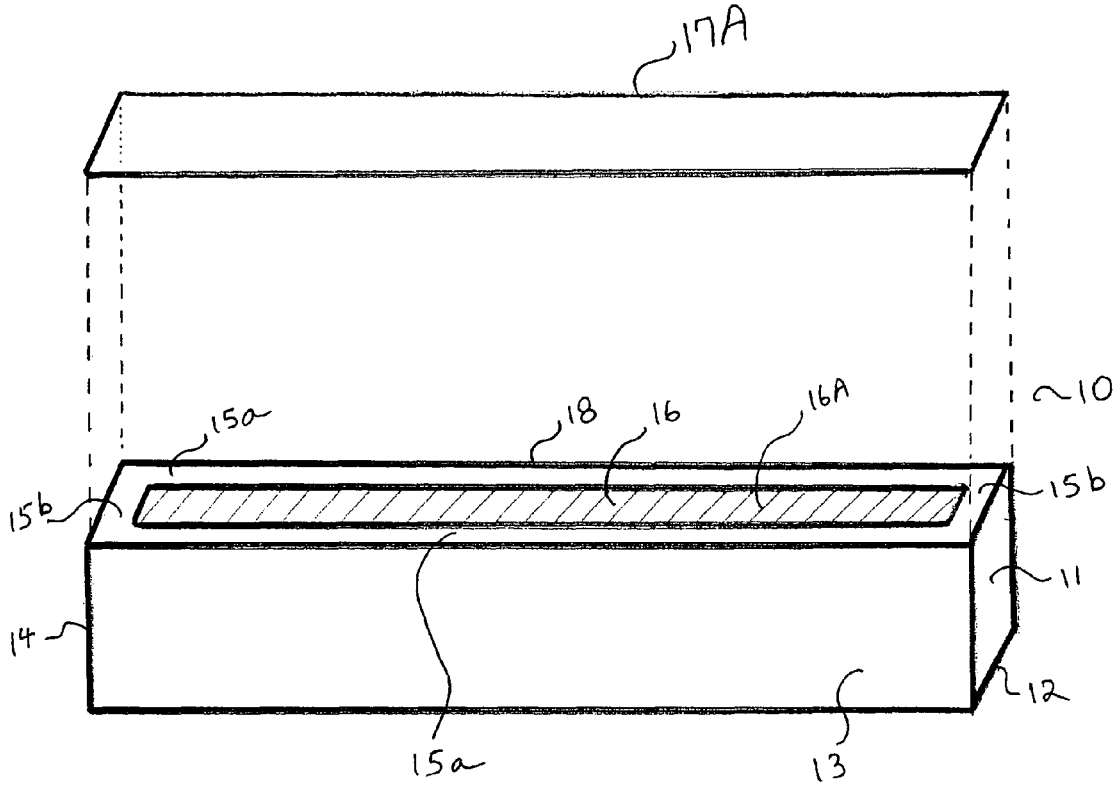
FIG. 9 shows an alternative embodiment of the present invention that employs a removable film or tape like covering used to seal the cartridge, in place of a rigid lid.

FIG. 9 is an alternative embodiment of the fuel cartridge 10 which uses a removable film or tape like covering 17A to seal the cartridge, in place of a rigid lid 17.

Figure 10:
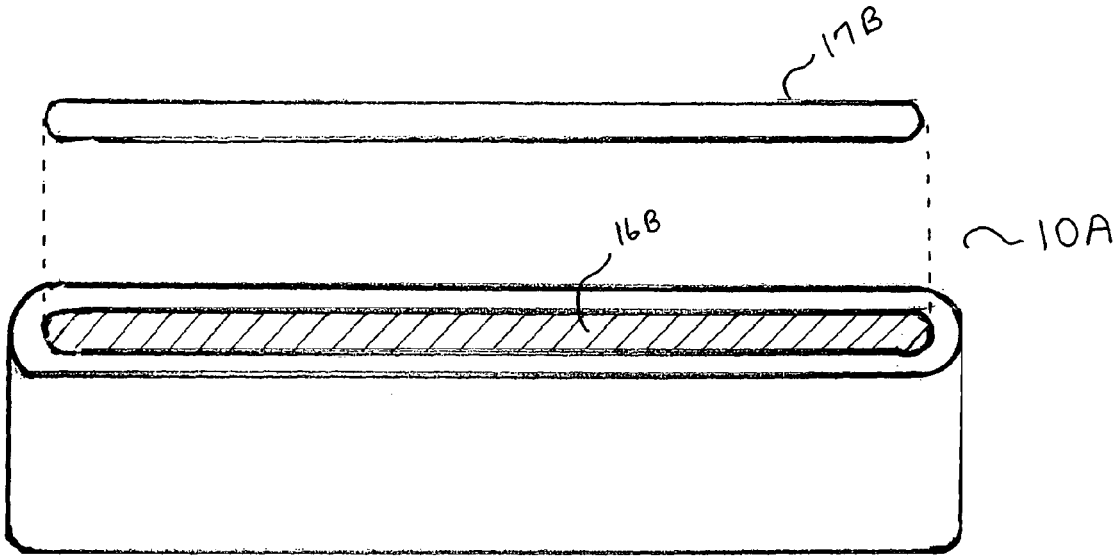
FIG. 10 shows an alternative embodiment of the present invention where the fuel cartridge and vapor exit aperture are both generally rectangular and have lengths substantially greater than their widths, without being exact rectangles.

FIG. 10 shows another alternative embodiment of the present invention where the fuel cartridge 10A and vapor exit 16B aperture are both generally rectangular and have widths substantially greater than their depths, but are not exact rectangles.

Operation

To operate the fuel cartridge in accordance with the present invention one removes the lid 17 from the fuel cartridge 10 thereby exposing the alcohol gel fuel 16 which is then ignited. A rectangular flame pattern 20 will result.

Alternative Embodiments

Variations in the length, width and depth of the rectangularly shaped fuel cartridge 10, and the size of the vapor restrictors 15*a-b,* will produce a larger or smaller fire 20 that can burn for longer or shorter periods of time. For example, one hour, two hour, or three hour fires 20 are possible, which fires 20 can have larger or smaller flames.

Various methods of sealing the fuel cartridges 10 may be employed, such as rigid friction lids 17 or a removable film or tape like covering 17A. Many other alternative methods of sealing the fuel cartridge 10 also exist, such as using "easy off" scored metal tops similar to those found on sardine or soda cans.

Additionally, the fuel cartridge 10 and/or the vapor restrictors 15*a-b* may be manufactured out of extremely thin metal foil. And, as FIG. 2 illustrates, the fuel cartridge 10 can have more than one vapor exit aperture 16.

Both the fuel cartridge 10 and vapor exit aperture 16 do not have to be exact rectangles in order to have widths substantially greater than their depths. Any shape whose width is substantially greater than its depth, as shown in FIG. 10, may be used for the fuel cartridge 10 and the vapor exit aperture 16 to accomplish the same result.

Thus, the scope of the invention should be determined by the appended claims and their legal equivalents, rather than by the specific descriptions of the exemplar fuel cartridge illustrated in the figures.

Advantages of the Present Invention

From the description above, a number of advantages of the present invention become evident:

(a) the invention provides a convenient, one piece, disposable fuel cartridge which produces a desirable rectangular flame pattern when the fuel inside is ignited.

(b) the invention provides a convenient, one piece, disposable fuel cartridge which burns fuel efficiently and requires less fuel than multiple "paint cans" require to produce a rectangular flame pattern, which paint cans cannot do.

(c) the invention provides a convenient, one piece, disposable fuel cartridge that produces a self regulating rectangular flame pattern that does not require the use of additional components mentioned in the prior art, such as a rectangular box "fuel cell" or a rectangular damper lid on top of the "fuel cell".

(d) the invention provides a convenient, one piece, disposable fuel cartridge whose configuration allows for efficient storage compared to round "paint cans".

I claim:

1. A self regulating fuel cartridge for a domestic fireplace comprising:

an elongate bottom wall;

a left-side wall;

a right-side wall;

an elongate front wall, and;

an elongate back wall, said walls being joined so as to define an elongate, substantially rectangular box, said substantially rectangular box having a width approximately equal to a length of one of either the front wall or the back wall, and having a depth approximately equal to one of either the left side wall or the right side wall, the bottom, right-side, left -side, front and back walls defining therebetween a fuel-receiving chamber filled with a gel fuel in intimate contact with at least the bottom, front and back walls, said gel fuel emitting flammable vapors for combustion, said fuel cartridge further comprising a noncombustible, flat top wall, said top wall being rigidly joined to the left, right, front and back walls and extending parallel to the bottom wall to enclose therebetween said fuel-receiving chamber, and said top wall being imperforate except for at least one elongate, rectangular vapor exit aperture extending longitudinally therethrough and being of predetermined, constant size;

said vapor exit aperture communicating with said fuel receiving chamber and permitting the exit of said flammable vapors from said fuel receiving chamber through said rectangular vapor exit aperture;

said top wall forming noncombustible vapor restrictors which extend, rigidly, from each of the front, back, left and right walls to said rectangular vapor exit aperture, the cartridge being self-regulating by said vapor restrictors so that a visible, elongate, rectangular flame pattern of predetermined size and shape corresponding to a size and shape of said at least one exit aperture is produced throughout combustion.

2. The cartridge of claim 1, further characterised in that said rectangular vapor exit aperture is adapted for receiving a removable lid which may open said rectangular vapor aperture.

3. A self regulating fuel cartridge for a domestic fireplace according to claim 1 wherein an area of the vapor restrictor is at least as large as an area of the vapor exit aperture.

4. A self regulating fuel cartridge for a domestic fireplace comprising:

a noncombustible housing having an elongate, rectangular bottom wall and an elongate, rectangular front wall, an elongate, rectangular back wall and elongate, opposite side walls, upstanding to a common height from the bottom wall to provide an elongate, imperforate, box-like, fuel receiving chamber, open at a top, and a flat top wall rigidly joined to the front, back and side walls to extend longitudinally across the chamber top, and a gel fuel which emits flammable vapors for combustion filling the chamber in intimate contact with the bottom, front and back walls, the top wall defining at least one elongate, rectangular vapor exit aperture of predetermined constant size extending longitudinally centrally along the chamber and surrounded by an imperforate vapor restrictor so that said at least one vapor exit aperture communicates with said fuel receiving chamber and permits exit of said flammable vapors from said fuel receiving chamber through said rectangular vapor exit aperture, the cartridge being self-regulating by said vapor restrictors so that a visible, elongate, rectangular flame pattern of predetermined size and shape corresponding to a size and shape of said at least one exit aperture is produced throughout combustion.

5. The cartridge of claim 4, further including a removable lid which may open said rectangular vapor exit aperture.

6. A self regulating fuel cartridge for a domestic fireplace according to claim 4 wherein an area of the vapor restrictor is at least as large as an area of the vapor exit aperture.

7. A self regulating fuel cartridge for a domestic fireplace comprising:

a noncombustible, one piece housing having an elongate, rectangular bottom wall and an elongate, rectangular front wall, an elongate, rectangular back wall and elongate, opposite side walls, upstanding to a common height from the bottom wall and a flat top wall joined to the front, back and side walls to extend longitudinally across the chamber top, the top wall defining at least one vapor exit aperture of predetermined, constant, elongate, rectangular shape and size, extending longitudinally centrally along the chamber and surrounded by an imperforate vapor restrictor to provide an elongate, imperforate, box-like, fuel receiving chamber, only open at a top, and a gel fuel which emits flammable vapors for combustion filling the chamber in intimate contact with the bottom, front and back walls so that said at least one vapor exit aperture communicates with said fuel receiving chamber and permits exit of said flammable vapors from said fuel receiving chamber only through said at least one rectangular vapor exit aperture, the cartridge being self-regulating by said vapor restrictors so that a visible, elongate, rectangular flame pattern of predetermined size and shape corresponding to a size and shape of said at least one exit aperture is produced throughout combustion.

8. A self regulating fuel cartridge for a domestic fireplace according to claim 7 wherein an area of the vapor restrictor is at least as large as an area of the vapor exit aperture.

9. A self regulating fuel cartridge for a domestic fireplace according to claim 7 wherein the housing is thin metal foil.

10. A self regulating fuel cartridge for a domestic fireplace according to claim 8 wherein the housing is thin metal foil.

* * * * *